United States Patent [19]

Lin et al.

[11] Patent Number: 4,809,411

[45] Date of Patent: Mar. 7, 1989

[54] METHOD FOR IMPROVING THE MAGNETIC PROPERTIES OF WOUND CORE FABRICATED FROM AMORPHOUS METAL

[75] Inventors: Kou C. Lin, Hermitage; Charles E. Burkhardt; Paul P. Corbett, both of Sharon, all of Pa.

[73] Assignee: Electric Power Research Institute, Inc., Palo Alto, Calif.

[21] Appl. No.: 339,780

[22] Filed: Jan. 15, 1982

[51] Int. Cl.[4] ..... H01F 7/06

[52] U.S. Cl. ..... 29/605; 148/108; 148/122; 72/128; 242/7.03

[58] Field of Search ..... 29/605, 609; 336/213, 336/234; 148/108, 122; 72/146, 147, 148, 128, 378, 392, 393; 242/7.03

[56] References Cited

U.S. PATENT DOCUMENTS

| | | | |
|---|---|---|---|
| 3,771,086 | 11/1973 | Poulsen | 29/605 |
| 3,986,654 | 10/1976 | Hart et al. | 72/378 |
| 3,991,462 | 11/1976 | Engel | 29/605 |
| 3,996,086 | 12/1976 | Worrall | 29/605 |
| 4,171,109 | 10/1979 | Roe | 267/156 |
| 4,298,409 | 11/1981 | DeCristofard et al. | 148/108 |

FOREIGN PATENT DOCUMENTS

| | | | |
|---|---|---|---|
| 51-73923 | 6/1976 | Japan | 148/108 |

OTHER PUBLICATIONS

Luborsky, Fred E. & Becker, Joseph J., "Strain Induced Anisotropy in Amorphous Alloys and the Effect of Toroid Diameter on Magnetic Properties," *IEEE Transactions on Magnetics*, vol. Mag. 15, No. 6, Nov. 1979, pp. 1939–1945 at 1944.

Rough Draft Translation of Japanese Patent.

*Primary Examiner*—P. W. Echols

*Attorney, Agent, or Firm*—Flehr, Hohbach, Test, Albritton, & Herbert

[57] ABSTRACT

A method for improving the magnetic properties of a core fabricated from at least one strip of amorphous metal wound about itself to form adjacent laminations in the shape or a closed loop is disclosed. In accordance with the method, a force in tension of predetermined strength is applied to the loop from the innermost lamination of the loop outwardly. While this tensile force is being applied, the loop is annealed simultaneously and subjected to a magnetic field of predetermined strength.

14 Claims, 1 Drawing Sheet

Figure 1:
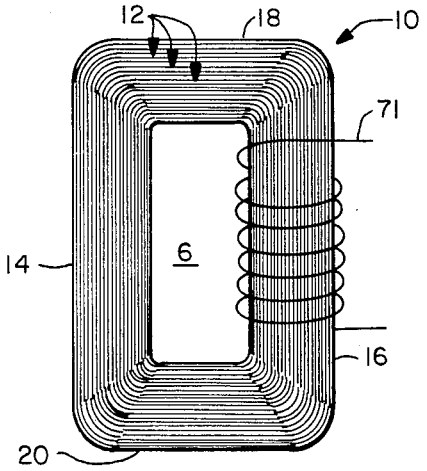

METHOD FOR IMPROVING THE MAGNETIC PROPERTIES OF WOUND CORE FABRICATED FROM AMORPHOUS METAL

The present invention relates generally to magnetic cores used in transformers and like electrical induction apparatus, and more particularly to a method for improving the magnetic properties of a wound core fabricated from amorphous strip metal.

Electrical induction apparatus, such as transformers and the like, are constructed of cores of magnetic material to provide a path for magnetic flux. One common way to make such a core is to use a magnetic strip material having a preferred direction of orientation parallel to the longitudinal direction of the material, for example, a non-amorphous material such as grain-oriented steel. This material is relatively rigid yet flexible and easy to form into the ultimate shape of the core, either before or after the core has been annealed.

Wound cores manufactured from grain-oriented steel are formed into their ultimate shape, if not already in that shape, in a number of different ways. For example, a wound core may be die formed with a press, capped with a set of casting molds, or clamped with plates or steel bands. The core would then be stress relief annealed to maintain it in its end shape.

Magnetic cores may also be made from amorphous strip material, for example, METGLAS amorphous strip metal manufactured by the Allied Chemical Company. (METGLAS is a registered trademark for Allied Chemical's amorphous metal alloys). Amorphous strip material is very thin, very brittle, and very hard, and thus, use of the material in magnetic cores is a problem. Nevertheless, it is desirable to use amorphous strip metal to form cores because the amorphous material has lower core loss characteristics than the non-amorphous material.

A number of techniques have been developed for enhancing the magnetic properties of amorphous metal alloys. One such technique, which is described in U.S. Pat. No. 4,053,333, issued Oct. 11, 1977, calls for stressing an amorphous metal strip at a temperature which is just below that at which the material melts or its crystalline structure begins to form. The strip material is maintained at this temperature for a predetermined period of time; after which, it is cooled. This technique increases the material's magnetic remanence while decreasing its coercivity.

Another technique for improving the magnetic properties of amorphous material is described in U.S. Pat. No. 4,053,332, issued Oct. 11, 1977. In accordance with this technique, an amorphous strip material is subjected to a compressive rolling process and then stressed such that its magnetic remanence is increased and its coercivity is decreased.

The technique described in U.S. Pat. No. 4,053,331, issued Oct. 11, 1977, teaches that the magnetic properties of an amorphous material may be enhanced by subjecting the material to a tensile stress for a given period of time wherein the tensile stress is less than that of the elastic limit of the material. In one suggested embodiment, opposite ends of the core material of a transformer are subjected to a pulling force in directions opposite one another. This technique, as with the above-two described techniques, increases the remanence of the amorphous material while decreasing its coercivity.

The core losses of a core fabricated from amorphous material may be reduced by annealing the core and simultaneously subjecting it to a magnetic field. The present invention is directed to a method for further improving the magnetic properties of an amorphous core. Particularly, with the method of the present invention, both the true watt loss and the exciting power of the core are reduced. The method of the present invention also facilitates the fabrication of amorphous cores. As amorphous material has a positive magnetostriction, any compressive force applied to the material during shaping of the core would be detrimental to core performance. With the method of the present invention, amorphous cores are shaped into their ultimate shape, if not already in that shape, by applying a force in tension.

The main object of the present invention is to provide a method for improving the magnetic properties of a core fabricated from amorphous strip material.

Another object of the present invention is to provide a method for shaping a wound amorphous core into its end shape while at the same time, improving the magnetic properties of the core.

In accordance with the method of the present invention, a wound core is formed from at least one strip of amorphous metal wound about itself to form adjacent laminations in the shape of a closed loop. A force in tension of predetermined strength is applied to the loop from the innermost lamination of the loop outwardly. While the tensile force is being applied, the loop is annealed and simultaneously subjected to a magnetic field of predetermined strength. The tensile force is applied to the loop such that the tensile force acting on the innermost lamination of the loop does not exceed 1200 mega-Pascals (mPa).

Figure 2:
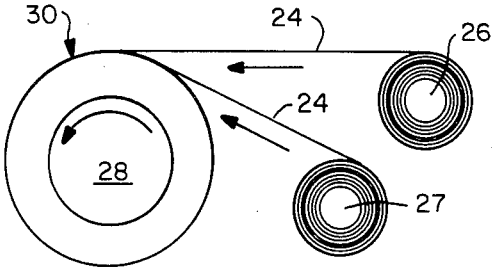
Figure 3:
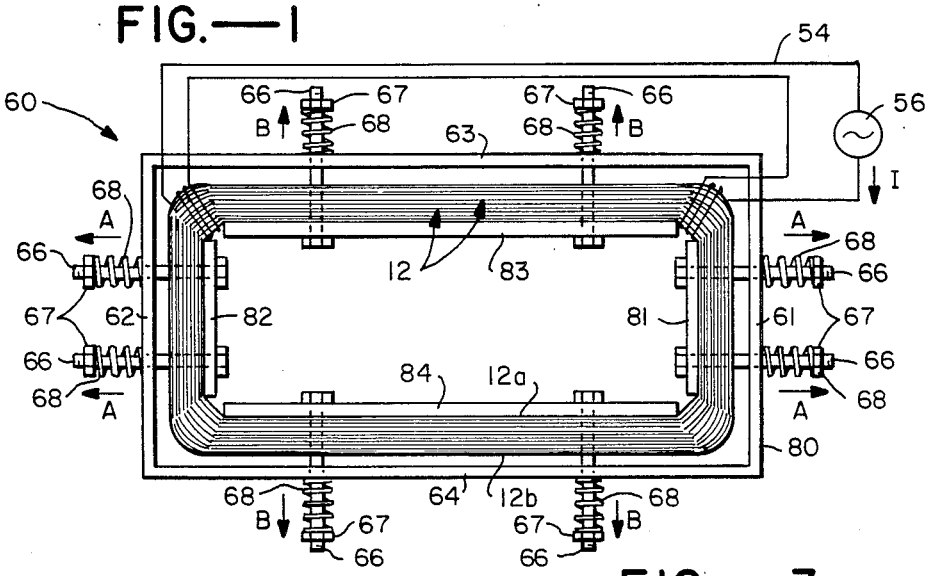
Figure 4:
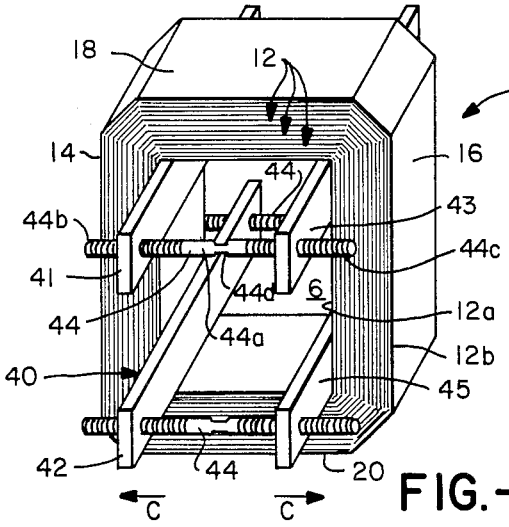
Figure 5:
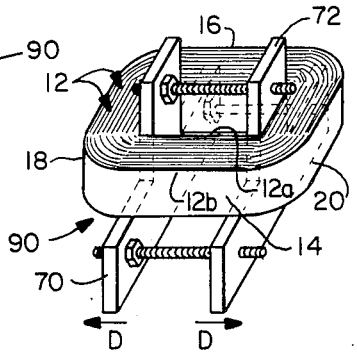

The method of the present invention will be described in more detail hereinafter in conjunction with the drawings wherein:

FIG. 1 is a side elevational view of a wound magnetic core fabricated from amorphous strip metal;

FIG. 2 schematically illustrates means for winding amorphous strip metal about a mandrel;

FIG. 3 is a schematic illustration which shows apparatus for shaping a magnetic core into its end shape by the application of a tensile force thereto; and FIGS. 4 and 5 schematically illustrate alternate apparatus to that shown in FIG. 3.

Referring now to the drawings, in which like components are designated by like reference numerals throughout the various figures, attention is first directed to FIG. 1 which shows a magnetic core 10 for use in an electrical inductive apparatus such as a transformer or the like. Core 10 is formed from at least one continuous strip of amorphous metal wound about itself to form adjacent laminations 12 in the shape of a closed loop. One example of the amorphous material making up the core is the METGLAS amorphous strip material referred to previously.

The core can be round, or it can have the rectangular shape shown. In the rectangular shape illustrated, core 10 includes opposite legs 14 and 16, an upper yoke 18, and a lower yoke 20. An associated electrical coil or coils are preferably assembled about core 10 by winding the coil or coils about a section of the core, as is well known in the art. One such coil is shown in FIG. 1 at 71. Alternatively, one of the core yokes or legs may include a joint, which is not shown, to provide access into and around the core for positioning an associated electrical coil or coils.

Turning to FIG. 2, attention is directed to a preferred method of making core 10 from one or more continuous strips of amorphous metal. In FIG. 2, two continuous strips 24 of amorphous metal are initially stored on their own reels 26 and 27 for winding about a mandrel. The continuous strips are wound about a cylindrical mandrel 28 to form an initially round core generally indicated at 30. It is preferred that core 30 be wound round so that the strips 24 are not subjected to a jerking or similar irregular motion that could cause the strips to break. Further, by winding the strips around mandrel 28 without excessive acceleration, the speed of winding can actually be increased.

After round core or closed loop 30 has been formed, the ultimate shape of the core may be provided by the apparatus shown in FIG. 3. The apparatus, generally indicated at 60, includes two steel or otherwise rigid side walls 61 and 62, and two steel or otherwise rigid top and bottom walls 63 and 64, respectively. As shown, closed loop 30 has been converted into the rectangular shape of FIG. 1. This rectangularly-shaped loop 90 is located inside box 80 formed by walls 61, 62, 63, and 64. Also disposed inside box 80 are four steel or otherwise rigid plates 81, 82, 83, and 84. Plates 81 and 82 are located opposite the box's short walls 61 and 62, respectively, and plates 83 and 84 are located opposite the long walls 63 and 64, respectively, of the box. Closed loop 90 is positioned in the box such that it is located between the walls of the box and the plates, and thus, the plates are disposed within loop window 6.

Each plate and the walls of the box include, preferably, two openings therein for the passage of a bolt 66 therethrough. Each bolt includes a nut 67 and a high-temperature coil spring 68. The coil springs are used to maintain hardware tightness during annealing of the loop, as will be discussed below. As shown, apparatus 60 includes four nut and bolt assemblies for applying a force in tension to loop 90 in the respective directions indicated by arrows A and B. Specifically, by tightening nuts 67 of each bolt, a tensile force is applied to loop 90 from its innermost lamination **12*a* towards its outermost lamination 12*b*. The tensile force applied in the direction of arrow A is acting on the short sections or yokes of the loop. The tensile force applied in the direction of arrow B is acting on the long sections or legs of the loop. To prevent innermost lamination 12*a*** from breaking the tensile force acting on that lamination is preferably between about 950 and 1200 mPa.

The above-described apparatus subjects the inner laminations of loop 90 to a severe tensile force. The outer laminations of the loop, however, will be subjected to a tensile force of a lesser magnitude, and thus, they will be somewhat loose. The outer laminations may be tightened by pulling the end of outermost lamination **12*b*** tightly around the loop.

The application of a magnetic field to an amorphous core manufactured from METGLAS material causes a slight physical expansion of the amorphous material. That is to say, the material has a positive magnetostriction. Accordingly, a compressive force applied to the core is detrimental to the core's magnetic properties. Thus, a core made from an amorphous material having a positive magnetostriction should preferably not be subjected to compressive forces, such as those that occur with certain core-shaping techniques. On the other hand, the application of a tensile force to the core at the time the core is annealed and subjected to a magnetic field will enhance the core's magnetic properties, as will be discussed hereinafter. In accordance with the method of the present invention, a closed loop is subjected to a tensile force to form the core into its end shape. If the closed loop is already in its final shape, a tensile force can still be applied to the loop, without changing its shape, during the time the loop is being annealed and subjected to a magnetic field to improve the core's magnetic characteristics. Additionally, the tensile force applied to the core in accordance with the method of the present invention will improve material flatness and increase the core's space factor.

The next step in the method of the present invention calls for annealing loop 90 while simultaneously subjecting it to a magnetic field. Loop 90 will be maintained in apparatus 60 during the time it is annealed and subjected to a magnetic field so that the requisite tensile force is applied. Loop 90 is provided with a current coil 54 which is wound about two sections of the core. The coil is connected to a current source 56, either direct current or alternating current, for the passage of a current generally indicated at I through the coil. The current subjects loop 90 to a magnetic field. The magnetic field is typically between about 5 and 20 oersteds. The particular strength of the magnetic field applied to the loop will depend upon the type of amorphous alloy from which core 10 is fabricated. For instance, if core 10 is fabricated from METGLAS amorphous alloy 2605 SC, the magnetic field applied to the loop will have a strength approximately 10 oersteds.

While the cores are being subjected to the magnetic field, they are also being annealed, preferably in a protective atmosphere. The protective atmosphere may be a vacuum, an inert gas such as argon, or a reducing gas such as a mixture of hydrogen and nitrogen. The annealing process typically requires that the amorphous loop be heated from ambient to a maximum temperature at a given rate. The process further requires that the loop be maintained at this temperature for a given period of time and then subsequently cooled at a given rate. The particular time and temperature parameters of the annealing process vary depending upon the type of amorphous material being annealed. METGLAS amorphous alloy 2605 SC is typically heated from ambient to a temperature of between 340° C. and 370° C. at a heating rate of about 10° C. per minute. Preferably, the alloy is heated to 365° C., and maintained at that temperature for a period of about 2 hours. Subsequently, the material is cooled to ambient at a cooling rate of 10° C. per minute. METGLAS amorphous alloy 2605 S-2 is heated to a temperature of between 390° C. and 410° C. at the same heating rate. Preferably, the 2605 S-2 alloy is heated to 400° C., and maintained at that temperature for a period of about 2 hours. It is then cooled to ambient at a cooling rate of 10° C. per minute.

After loop 90 has been annealed and subjected to a magnetic field as described, current coil 54 is removed, and loop 90 is taken out of apparatus 60. Loop 90 has thus become core 10. The final electrical coil or coils 71 can then be placed around a section of the core in a suitable manner.

The apparatus of FIG. 3 shapes the closed loop of amorphous strip material into its final shape, if not already in its final shape, by the application of a tensile force thereto. The tensile force is applied from the innermost lamination of the loop outwardly. The application of this tensile force during the time the core is being annealed and subjected to a magnetic field improves the core's magnetic characteristics. Table I provides a comparison which illustrates that a core annealed and subjected to a magnetic field under tension has better magnetic properties than a core not subjected to a force in tension. As can be seen from Table I, a core manufactured in accordance with the method of the present invention has lower true watt losses and exciting power requirements.

TABLE I

| Induction in (Kilo-Gauss) | Annealed and Subjected to a Magnetic Field Under Tension | | Annealed and Subjected to a Magnetic Field Without Tension | |
|---|---|---|---|---|
| | TW/Lb. | VA/Lb. | TW/Lb. | VA/Lb. |
| Core Mean Length 23" | | | | |
| 10 | .054 | .057 | .065 | .177 |
| 12 | .074 | .082 | .097 | .703 |
| 12.64 | .082 | .095 | .110 | 1.11 |
| 13 | .087 | .105 | .117 | 1.45 |
| 14 | .101 | .165 | .140 | 3.12 |
| 15 | .120 | .427 | .177 | 7.03 |
| Core Mean Length 29" | | | | |
| 10 | .052 | .054 | .070 | .272 |
| 12 | .071 | .077 | .102 | .991 |
| 12.64 | .078 | .087 | .113 | 1.50 |
| 13 | .083 | .094 | .120 | 1.89 |
| 14 | .098 | .130 | .134 | 3.58 |
| 15 | .119 | .339 | .149 | 7.18 |

where TW/Lb. represents the true watt loss in watts per pound, and VA/Lb. represents the exciting power in volt amps per pound.

It is to be understood that core 10 may be manufactured in accordance with the method of the present invention to have any desired shape. For instance, if core 10 is to be circular, the apparatus in FIG. 3 may comprise a circular box which applies the requisite tensile force to the core from its innermost lamination outwardly. Further, as indicated heretofore, the method of the present invention may be used even if the closed loop of amorphous material is already in the final shape of the core.

An apparatus different from that shown in FIG. 3 for applying a tensile force to closed loop 90 is illustrated in FIG. 4. That apparatus includes plates 41, 42, 43, and 45 positioned within loop window 6. Plate 41 is positioned on one side of the loop and plate 43 on the opposite side. Plates 41 and 43 are located at the upper portion of the loop near yoke 18. The plates are connected by means of two bolt assemblies 44, only one of which is shown, located at the respective opposite ends of the plates. Bolt assemblies 44 comprise a bolt **44*a* which has right-hand threads 44*b* at one end and left-hand threads 44*c* at the other end. Threaded portion 44*b* of the bolt extends through a threaded opening in plate 41, and threaded portion 44*c* extends through a similar opening in plate 43. By applying a suitable force to bolt 44*a* at flat portion 44*b*, plates 41 and 43** may be forced apart as indicated by arrows C.

Plates 42 and 45 are likewise disposed on opposite sides of the loop, but they are located at the lower portion of the loop near yoke 20. Plates 42 and 45 are connected together by means of two other bolt assemblies 44. By turning the bolts of the bolt assemblies connecting plates 42 and 45, plates 42 and 45 can be made to move away from each other as indicated by arrows C.

FIG. 5 illustrates another apparatus for applying a tensile force to closed loop 90. As shown, two T-shaped plates 70 and 72, which may be driven apart by a nut and bolt arrangement, is used to apply a tensile force to loop 90 in the direction of arrows D.

Although certain specific embodiments of the invention have been described herein in detail, the invention is not to be limited to only such embodiments, but rather only by the appendant claims.

What is claimed is:

1. A method for improving the magnetic properties of a magnetic core formed from at least one strip of amorphous metal wound about itself to form adjacent laminations in the shape of a closed loop, comprising:

applying a tensile force of predetermined strength to the loop from the innermost lamination of the loop outwardly;

while said tensile force is being applied, annealing the loop; and simultaneously subjecting the loop to a magnetic field of predetermined strength.

2. The method of claim 1 wherein said tensile force applied to the innermost lamination of the loop is not greater than 1200 mega-Pascals.

3. The method of claim 2 further including drawing the end of the outermost lamination of said loop about said loop to tighten the outer laminations of said loop.

4. The method of claim 3 including the steps of annealing the core in a special non-ambient atmosphere for about two hours at a temperature of between 340° C. and 370° C. while simultaneously subjecting the loop to a magnetic field strength of between about 5 oersteds and 20 oersteds.

5. The method of claim 4 including the steps of annealing the loop in a special non-ambient atmosphere for about two hours at a temperature of about 365° C. while simultaneously subjecting the loop to a magnetic field strength of 10 oersteds.

6. The method of claim 3 including the steps of annealing the core in a special non-ambient atmosphere for about two hours at a temperature of between 390° C. and 410° C. while simultaneously subjecting the loop to a magnetic field strength of between about 5 oersteds and 20 oersteds.

7. The method of claim 4 including the steps of annealing the loop in a special non-ambient atmosphere for about two hours at a temperature of about 400° C. while simultaneously subjecting the loop to a magnetic field strength of 10 oersteds.

8. A method of fabricating a magnetic core of an electrical induction apparatus, comprising the steps of;

winding a continuous strip of amorphous metal about a mandrel to form adjacent laminations in the shape of a closed loop;

applying a tensile force to said loop from the innermost lamination of said loop outwardly;

while applying said tensile force, heating said loop to a predetermined temperature;

maintaining said loop at said predetermined temperature for a predetermined period of time;

simultaneously subjecting said loop to a magnetic field of predetermined strength;

subsequently cooling said loop to ambient temperature; and after said loop has cooled to ambient temperature, removing said tensile force and said magnetic field.

9. The method of claim 8 further including the step of drawing the end of the outermost lamination of said loop about said loop to tighten the outermost laminations of said loop.

10. The method of claim 9 including the step of applying a tensile force of between about 950 and 1200 mega-Pascals to the innermost lamination of said loop.

11. The method of claim 10 including the step of heating said loop to a temperature of about 365°.

12. The method of claim 11 or 10, including the step of maintaining said loop at said temperature for about two hours.

13. The method of claim 12 including the step of subjecting said loop to a magnetic field having a strength of about 10 oersteds.

14. The method of claim 10 including the step of heating said loop to a temperature of about 400° C.

* * * * *

UNITED STATES PATENT AND TRADEMARK OFFICE

CERTIFICATE OF CORRECTION

PATENT NO. : 4,809,411

DATED : March 7, 1989

INVENTOR(S) : Lin, et al.

It is certified that error appears in the above—identified patent and that said Letters Patent is hereby corrected as shown below:

Claim 11, line 2 "365°" should read --365°C"

Signed and Sealed this

Twenty-sixth Day of September, 1989

*Attest:*

DONALD J. QUIGG

*Attesting Officer*

*Commissioner of Patents and Trademarks*